US007192369B2

(12) United States Patent
Morrow

(10) Patent No.: US 7,192,369 B2
(45) Date of Patent: Mar. 20, 2007

(54) MESH POCKET FOR LACROSSE STICK

(75) Inventor: David Morrow, Farmington Hills, MI (US)

(73) Assignee: Warrior Lacrosse, Inc., Warren, MI (US)

( * ) Notice: Subject to any disclaimer, the term of this patent is extended or adjusted under 35 U.S.C. 154(b) by 120 days.

(21) Appl. No.: 10/104,841

(22) Filed: Mar. 22, 2002

(65) Prior Publication Data

US 2002/0173389 A1 Nov. 21, 2002

Related U.S. Application Data

(60) Provisional application No. 60/278,532, filed on Mar. 23, 2001.

(51) Int. Cl.
*A63B 59/02* (2006.01)
*A63B 65/12* (2006.01)

(52) U.S. Cl. ..... 473/513; 473/528

(58) Field of Classification Search ..... 473/513, 473/512, 514; D21/724
See application file for complete search history.

(56) References Cited

U.S. PATENT DOCUMENTS 4,049,273 A * 9/1977 Pool ..... 473/513
4,097,046 A * 6/1978 Friant ..... 473/513
4,861,042 A * 8/1989 Trettin ..... 473/513
D318,509 S 7/1991 Naumburg, Jr.
5,174,580 A * 12/1992 Pratt ..... 473/513
5,209,489 A * 5/1993 Dorny et al. ..... 473/508
5,269,532 A * 12/1993 Tucker et al. ..... 473/513

FOREIGN PATENT DOCUMENTS

GB 1589596 * 5/1981

OTHER PUBLICATIONS

Web Page, Lacrosse Stick Workshop, Oct. 13, 1999,www.e-la-crosse.com/stech7.htlm, 6 pages.*

* cited by examiner

*Primary Examiner*—Eugene Kim
*Assistant Examiner*—M. Chambers
(74) *Attorney, Agent, or Firm*—John S. Artz; Artz & Artz, P.C.

(57) ABSTRACT

A pocket for a lacrosse head (10) includes a mesh portion (20) attached to the lacrosse head (10). The mesh portion (20) has a plurality of holes (22) therein. Furthermore, the mesh portion (20) has less than nine holes (22) disposed within a horizontal row between a pair of opposing sidewall portions (12) of the lacrosse head (10).

10 Claims, 3 Drawing Sheets

MESH POCKET FOR LACROSSE STICK

CROSS-REFERENCE TO RELATED APPLICATION

The present application claims priority from U.S. Provisional Application Ser. No. 60/278,532, filed Mar. 23, 2003 entitled "Five Hole Mesh For Lacrosse Head", the disclosure of which is incorporated by reference herein.

TECHNICAL FIELD

The present invention relates generally to lacrosse sticks, and more particularly to mesh pockets for heads of lacrosse sticks.

BACKGROUND OF THE INVENTION

Current lacrosse sticks have heads with one of two known conventional pockets. First, traditional pockets typically consist of four adjustable leather thongs that extend between the lacrosse scoop and the base of the head. Soft fabric laces, i.e. nylon laces, are interwoven with the thongs to form the pocket for holding the ball in the head. The laces are held in place by sidewall strings attached to the opposing sidewalls. The stiffness of the leather thongs provides for precise ball control in high velocity throwing and shooting.

Disadvantages of the traditional pockets include the extensive maintenance required of the pocket, the damage to the pocket when the leather thongs are exposed to moisture, and poor ball control while running. Repeated use of the pocket stretches the leather thongs so as to change the shape of the pocket and the performance thereof. The user must adjust the leather thongs to maintain the desired shape of the pocket and its associated performance.

Furthermore, the leather thongs stretch and shrink unevenly when they dry after being exposed to moisture, as typically is the case when lacrosse games are held in the rain. The resulting uneven shrinkage requires further adjustment of the thongs.

Mesh strung pockets are also known. The mesh pockets are typically formed of a soft fabric material and are comprised of a single unit that attaches to the lacrosse head. Current mesh pockets are configured such that they have ten holes across, sometimes referred to as ten hole mesh. Mesh pockets are looser than traditional pockets thereby providing greater ball control while running. Another benefit of this mesh pocket is that it does not require the extensive maintenance that traditional pockets require. Also, mesh pockets are relatively inexpensive.

However, the looser netting and smaller holes therein produce comparably poor throwing and shooting results. In particular, the flexible pocket does not have the required stiffness for providing accurate, high velocity throwing and shooting. In addition, the holes in current mesh pockets are so small that no portion of the ball is cupped within any hole. In this regard, the ball merely rests on a top surface of the mesh pocket. This results in less friction between the ball and the pocket thereby reducing ball control.

Therefore, it would be desirable to provide a lacrosse pocket that provides for accurate, high velocity throwing and shooting, affords sufficient ball control while running, requires minimal maintenance, and is inexpensive.

SUMMARY OF THE INVENTION

The present invention provides a pocket for a lacrosse head. The pocket includes a mesh portion disposed between a pair of opposing sidewalls of the lacrosse head. The mesh portion has a plurality of holes therein and preferably has less than nine holes disposed within a horizontal row between the pair of opposing sidewalls.

One advantage of the present invention is that the mesh pocket provides the stiffness required for accurate, high velocity throwing and shooting.

Yet another advantage of the present invention is that minimal maintenance is required to keep the mesh pocket in its desired shape.

Still yet another advantage of the present invention is that material and assembly costs are inexpensive.

Other advantages of the present invention will become apparent when viewed in light of the detailed description of the preferred embodiment when taken in conjunction with the attached drawings and appended claims.

DESCRIPTION OF THE PREFERRED EMBODIMENT

Figure 1:
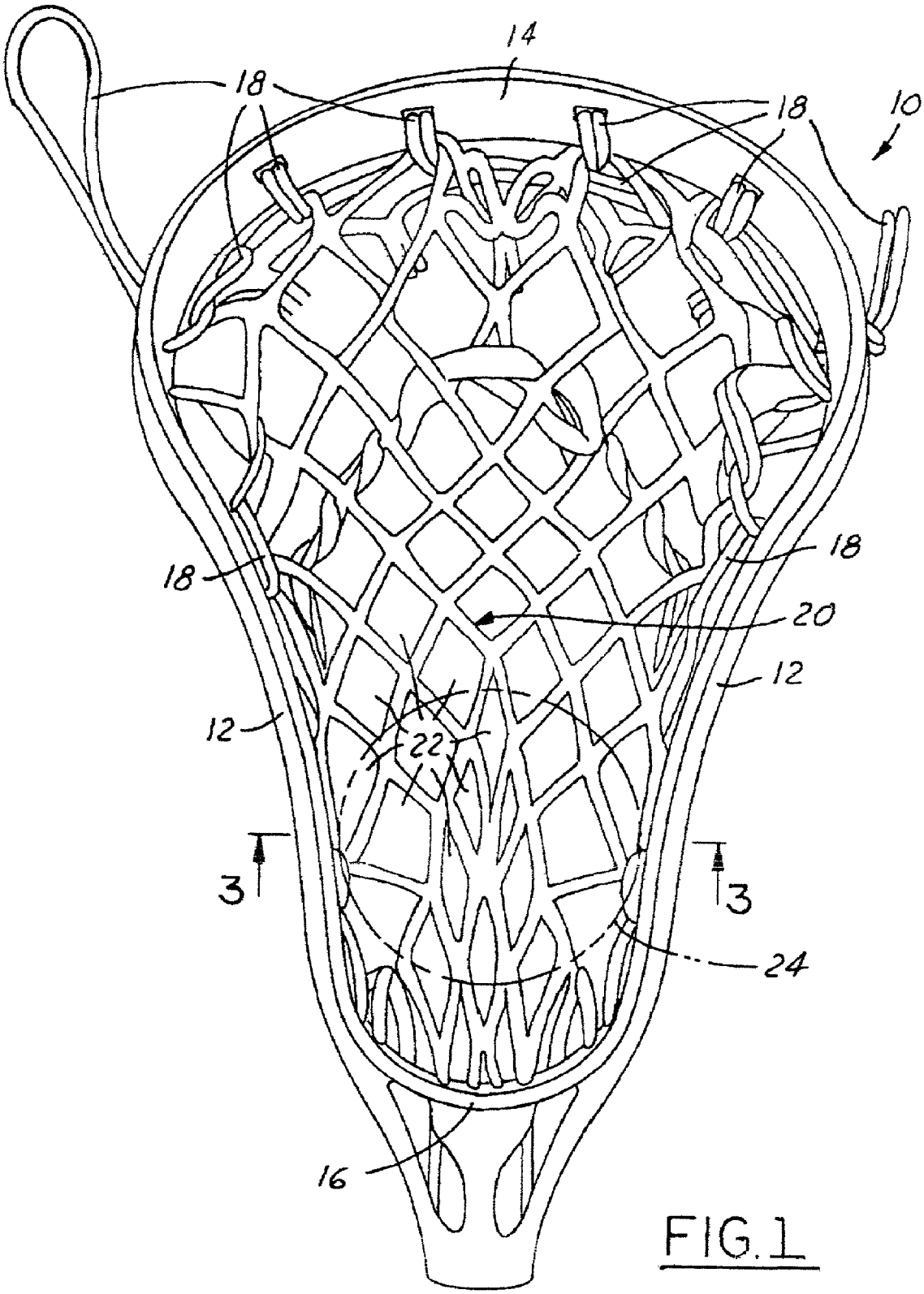
FIG. 1 is a front view of a lacrosse head with a mesh pocket according to a preferred embodiment of the invention.

In the following figures, the same reference numerals are used to identify the same components in the various views.

Figure 2:
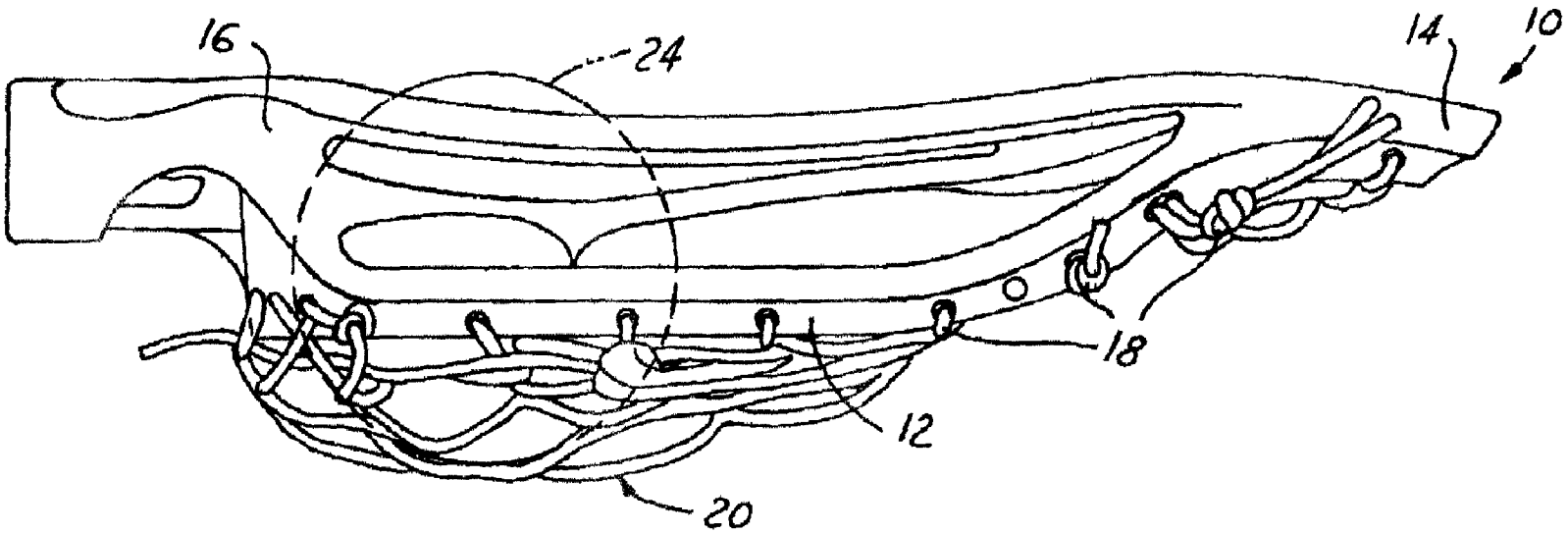
FIG. 2 is a side view of a lacrosse head with a mesh pocket according to a preferred embodiment of the invention.

Referring to FIGS. 1 and 2, there are shown front and side views, respectively, of a lacrosse head 10 with a mesh pocket according to a preferred embodiment of the present invention. The lacrosse head 10 includes a pair of opposing sidewall portions 12 connected to each other at their top ends by a scoop portion 14 and at their bottom ends by a base portion 16 of the lacrosse head 10.

Preferably, sidewall stringing 18 is laced through a series of apertures within all the portions 12, 14, 16 of the lacrosse head 10. These portions generally comprise an integral frame. The sidewall stringing 18 is interwoven with a mesh portion 20 so as to secure the mesh portion 20 to the lacrosse head 10. Alternatively, the mesh portion 20 may be secured to the lacrosse head 10 by directly stringing it through the series of apertures.

The preferred embodiment further requires that the mesh portion 20 is a soft fabric material with a plurality of holes 22 therein. The mesh portion 20 is preferably composed of a synthetic material. Examples of the synthetic material include nylon and polyester.

Furthermore, the mesh portion 20 is preferably treated with a stiffening agent, i.e. polyurethane, for hardening the mesh and providing resistance to moisture absorption. By hardening the mesh portion 20, the stiffening agent prevents deformation of the pocket thereby allowing the pocket to retain a more uniform shape. In this regard, a well formed pocket treated with the stiffening agent may consistently provide for desirable performance without the need for maintaining the mesh. Furthermore, the increased hardness of the mesh portion 20 allows for quick release, as well as accurate throwing and shooting with significant speed, i.e. whip.

The stiffening agent water-proofs the mesh portion 20 so as to prevent the mesh portion 20 from stretching or shrinking. In doing so, the stiffening agent preserves the shape of the pocket and its associated performance. Also, the resistance to moisture absorption prevents damage to the material composing the mesh portion 20. Consequently, the strengthening agent increases the life of the mesh portion 20 and causes it to provide performance similar to traditional stringing without the expense associated with traditional pockets.

The mesh portion 20 has less than nine holes 22 disposed within a horizontal row from one sidewall portion 12 to the opposing sidewall portion 12. In the preferred embodiment, the mesh portion 20 includes three to six diamond-shaped holes 22, which are disposed within a horizontal row. More preferably, the mesh portion 20 includes five diamond shaped holes 22 disposed within a horizontal row.

Figure 4:
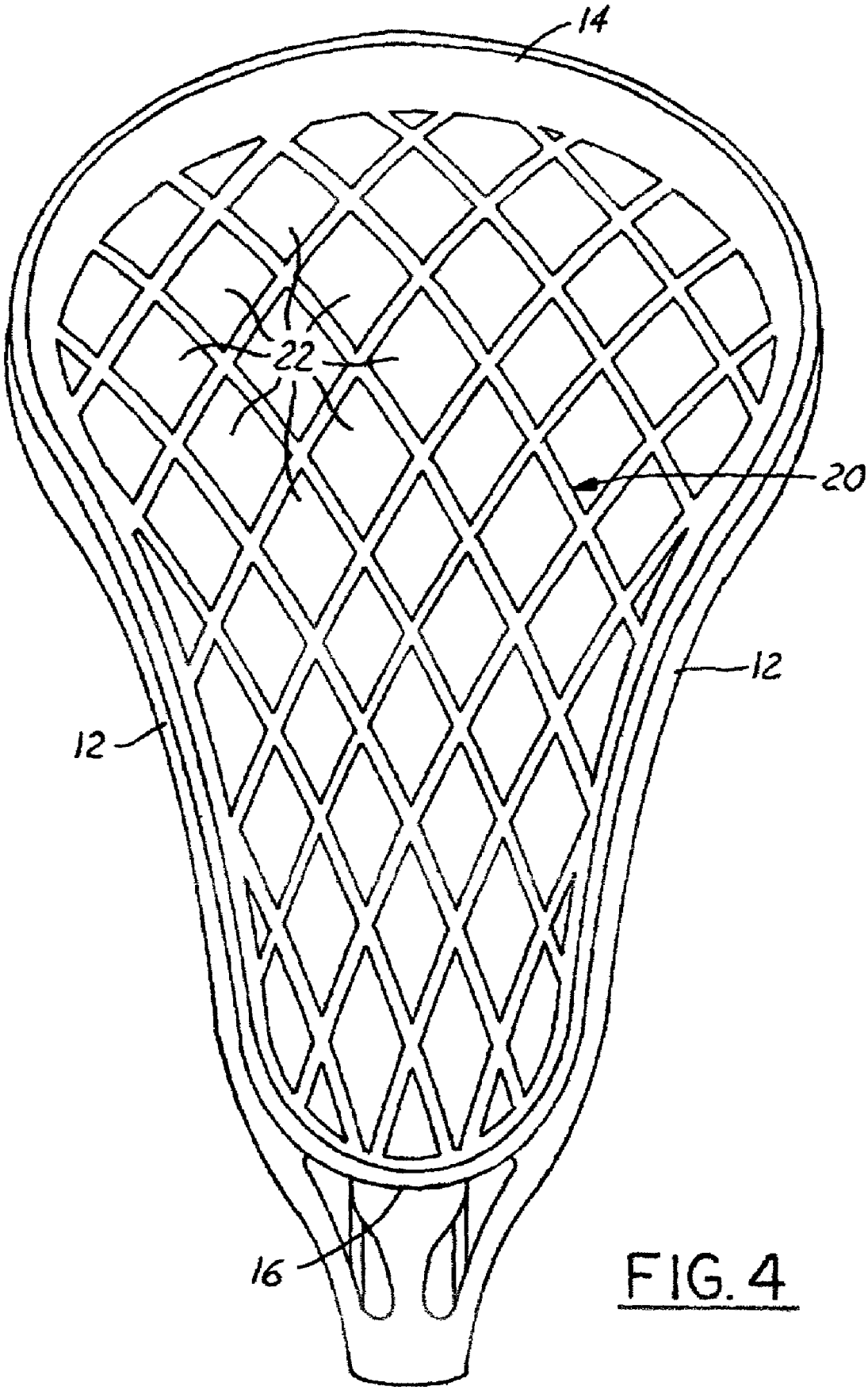
FIG. 4 is a perspective view of a lacrosse head having a mesh pocket integrally formed therein according to an alternative embodiment of the invention.

In an alternative embodiment, as shown in FIG. 4, the mesh portion 20 is integrally formed within the lacrosse head 10 thereby dispensing with the need for the sidewall stringing 18. In particular, the mesh portion 20 and the lacrosse head 10 are portions of a single injection molded item. Accordingly, the mesh portion 20 is composed of the same material, i.e. plastic, as the lacrosse head 10. As a result, the mesh portion 20 is sufficiently rigid so as to keep a consistent pocket shape and to reduce maintenance thereof. Furthermore, the stiffness of the mesh portion 20 also allows for precise throwing and shooting.

Figure 3:
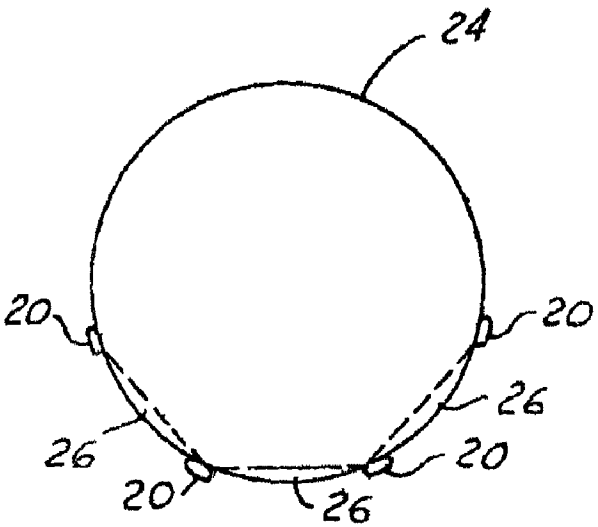
FIG. 3 is a cross-sectional view of a mesh pocket with a lacrosse ball disposed therein, as shown in FIG. 1 taken along line 3—3, according to a preferred embodiment of the invention.

Turning now to FIG. 3, the preferred embodiment requires that the holes 22 are sized sufficiently large for allowing the mesh portion 20 to cup portions 26 of a lacrosse ball 24 within the holes 22. This type of engagement between the lacrosse ball 24 and the mesh portion 20 provides substantial friction between the lacrosse ball 24 and the mesh portion 20. Consequently, the user has improved grip on the ball 24 for greater control in throwing and shooting. In an alternative embodiment, the integral plastic lacing may have a scuffed surface to provide better ball retention.

In an alternative embodiment, the mesh portion 20 may have less than three holes 22 in a horizontal row. By decreasing the number of holes 22 in a horizontal row, the size of each hole 22 will typically increase. The larger size of holes 22 may result in the tendency of the ball 24 to rock from one hole 22 to another hole 22 in the pocket. Such an engagement between the ball 24 and the mesh portion 20 decreases smoothness in handling and overall ball control.

In yet another alternative embodiment, the mesh portion 20 may have seven to nine holes 22 disposed within a horizontal row. The increase in the number of holes 22 in a horizontal row will typically decrease the size of the holes 22. As a result, smaller portions 26 of the ball 24 are cupped within the holes 22 thereby decreasing the amount of friction between the mesh portion 20 and the ball 24. The reduction in friction may decrease accuracy in throwing and shooting the ball 24.

While particular embodiments of the invention have been shown and described, numerous variations and alternate embodiments will occur to those skilled in the art. Accordingly, it is intended that the invention be limited only in terms of the appended claims.

What is claimed is:

1. A pocket for a lacrosse head, the pocket comprising:

a mesh portion for attachment to the lacrosse bead, said mesh portion constructed of an integral piece of material having a plurality of holes therein, said mesh portion having between three to eight holes disposed within a horizontal row between a pair of opposing sidewalls of the lacrosse head, said horizontal row being disposed in an upper half of the lacrosse bead adjacent a scoop of the lacrosse head, said plurality of holes being sized larger then holes in conventional mesh netting so as to cup a lacrosse ban within said plurality of holes and provide friction between said lacrosse ball and said mesh portion;

wherein said plurality of holes directly about each other within said horizontal row with no offset distance therebetween;

wherein said mesh portion is comprised of a woven synthetic material that is sufficiently rigid for forming a pocket and retaining a shape of said pocket.

2. The pocket of claim 1 wherein said mesh portion is coated with a stiffening agent.

3. The pocket of claim 2 wherein said coating provides said mesh portion with water resistant characteristics.

4. The pocket of claim 1 wherein said synthetic material is selected from the group consisting of nylon and polyester.

5. The pocket of claim 1, wherein said plurality of holes are generally diamond shaped.

6. The pocket of claim 1, wherein five holes and disposed within said horizontal row.

7. A pocket for a lacrosse head, the pocket comprising:

a mesh portion for attachment to the lacrosse head, said mesh portion having a plurality of holes integrally formed therein, said mesh portion having between three to six holes disposed within a horizontal row between a pair of opposing sidewalls of the lacrosse head, said horizontal row being disposed within an upper half of the lacrosse head adjacent to a scoop of the lacrosse head, said openings being sized to cup a lacrosse ball and assist in retaining it in said mesh portion, said mesh portion having a coating applied thereto for stiffening said mesh portion;

wherein said plurality of holes have a plurality of center portions that are each substantially aligned within said horizontal row with no gap between each of said plurality of holes.

8. The pocket of claim 7, wherein said plurality of holes are generally diamond shaped.

9. The pocket of claim 7, wherein five holes are disposed within said horizontal row.

10. The pocket of claim 7 wherein said coating provides prevents said mesh portion with water resistant characteristics.

* * * * *

UNITED STATES PATENT AND TRADEMARK OFFICE

CERTIFICATE OF CORRECTION

PATENT NO. : 7,192,369 B2
APPLICATION NO. : 10/104841
DATED : March 20, 2007
INVENTOR(S) : David Morrow It is certified that error appears in the above-identified patent and that said Letters Patent is hereby corrected as shown below:

In the Claims

Claim 1:
Column 4, Line 17, should read as follows: --mesh netting so as to cup a lacrosse ball within said--

Signed and Sealed this

Eighteenth Day of March, 2008

JON W. DUDAS
*Director of the United States Patent and Trademark Office*